US006986233B1

(12) United States Patent
Covington et al.

(10) Patent No.: US 6,986,233 B1
(45) Date of Patent: Jan. 17, 2006

(54) BALE DEWIRING SYSTEM

(75) Inventors: Donald T. Covington, Burlington, KY (US); Paul R. Szadziewicz, Elmhurst, IL (US); Stanislaw Witczak, Lincolnshire, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/930,266

(22) Filed: Aug. 31, 2004

(51) Int. Cl.
*B65B 69/00* (2006.01)

(52) U.S. Cl. ..... 53/381.2; 29/564.3; 29/426.4; 53/523; 83/909

(58) Field of Classification Search ..... 53/381.2, 53/523; 29/564.3, 426.3, 426.4; 83/909
See application file for complete search history.

(56) References Cited

U.S. PATENT DOCUMENTS

| | | | | |
|---|---|---|---|---|
| 2,820,282 | A * | 1/1958 | Schneider, Jr. | 29/564.3 |
| 3,513,522 | A * | 5/1970 | Thomson | 83/909 |
| 4,261,395 | A * | 4/1981 | Gronau | 83/909 |
| 4,841,619 | A * | 6/1989 | Theriault | 29/426.3 |
| 4,850,087 | A * | 7/1989 | Gronau | 29/426.4 |
| 5,052,098 | A * | 10/1991 | Thumm | 29/564.3 |
| 5,216,797 | A * | 6/1993 | Hall | 29/426.4 |
| 5,249,341 | A * | 10/1993 | Gronau | 29/426.4 |
| 5,406,690 | A * | 4/1995 | Neilsen et al. | 29/564.3 |
| 5,680,691 | A * | 10/1997 | Marom et al. | 29/564.3 |
| 5,813,199 | A * | 9/1998 | Temburg | 53/381.2 |
| 6,044,738 | A * | 4/2000 | Hawley et al. | 29/426.4 |
| 6,393,688 | B1 * | 5/2002 | Axner | 29/564.3 |

FOREIGN PATENT DOCUMENTS

| | | | |
|---|---|---|---|
| GB | 2184704 A | * | 7/1987 |
| WO | WO 90/00498 | * | 1/1990 |

* cited by examiner

*Primary Examiner*—Stephen F. Gerrity
(74) *Attorney, Agent, or Firm*—Mark W. Croll, Esq.; Donald J. Breh, Esq.; Welsh & Katz, Ltd.

(57) ABSTRACT

A bale dewiring system for removing one or more wires wrapped around a bale from the bale includes a frame, a bale receiving region defined by the frame and defining a longitudinal direction, an upper compression platen mounted to the frame for vertically moving into contact with the bale to compress the bale, and side compression plates movable in the longitudinal direction into contact with the bale to compress the bale. A rail is operably mounted to the upper platen for vertical movement therewith. A cutting assembly is mounted to the rail for movement along the rail for cutting the one or more wires. A winding assembly is operably mounted to the frame and includes a rotating winding element having a wire receiving region and a wire winding region for winding the cut wires to remove the wires from the bale.

24 Claims, 11 Drawing Sheets

BALE DEWIRING SYSTEM

BACKGROUND OF THE INVENTION

The present invention relates to a system for handling and dewiring bales. More particularly, the present invention is directed to a system for removing wire from bales, controlling decompression of the bale and collecting the removed wire.

Many items are bundled or baled for handling, transport and storage. For example, recycled materials are often gathered and bundled together, in a bale, for ease of transportation and handling. In the case of plastics for recycling, the bale of material for recycling is maintained by wire that is wrapped around the material to compress the material.

The material is often well compressed. As such, as the wire is severed or removed from the bale, the material will rapidly expand to a less compressed (or decompressed) state. In order to use the material, e.g., feed the material into a recycling process, the wire must be removed and the material loosened. Subsequent processes can include sorting, foreign object removal and cleaning.

Typically, dewiring (or more generally depackaging) operations were carried out manually. In such an operation, an operator would manually cut the wire or strapping. Moreover, such manual operations can be time consuming and can possibly cause injury.

One known automated dewiring system is configured such that as the wires are cut and the bale expands, the material expands into a confined space. As such, the space into which the material can expand is limited. In the event that the material expands to a volume greater than anticipated, the material can be come lodged in the system and disrupt operations.

In such a system the wires are cut by a saw that traverses along the entire length of the bale. While this functions well to sever the wire, it tends to burn the recycling materials due to the friction generated by the blade rotating through the material.

Accordingly, there is a need for a bale dewiring system that compresses a baled load prior to severing the baling wires. Desirably, such a system is configured to control the expansion of the bale (after the wire is cut), and to collect the wire after cutting for disposal. Most desirably, such a system minimizes operator time and attention required to maintain the system operating.

SUMMARY OF THE INVENTION

A bale dewiring system is configured for removing one or more wires wrapped around a bale from the bale. The system includes a frame, a receiving region for receiving the bale, an upper compression platen mounted to the frame, side compression plates, a cutting assembly and a wire winding assembly.

The upper compression platen moves vertically into contact with the bale to compress the bale. The cutting assembly is mounted to a rail that is mounted to the upper platen for vertical movement with the platen. The rail is mounted transverse to the longitudinal direction of the dewiring system.

The side compression plates are movable in the longitudinal direction into contact with the bale to compress the bale, and out of contact with the bale. The bale is compressed prior to cutting the wires to control the rate of decompression of the bale. The side compression plates move in a direction transverse to the movement of the cutting assembly.

The winding assembly is configured to wind the cut wire. The winding assembly includes a rotating winding element having a wire receiving region and a wire winding region.

In a present system, the cutting element is movable into contact with the bale and wire to cut the wire and out of contact with the bale following cutting the wire. Movement into and out of contact with the bale is controlled by a sensor that senses when the cutting element is near a wire and moves the cutting element into contact with the wire. Movement of the cutting element is independent of the cutting assembly movement along the rail.

The winding element is configured having a rotating shaft. A longitudinal slot is formed in the shaft for receiving the wire such that wire winds around the shaft as the shaft rotates. The winding assembly can include a sleeve and a retaining cap operably connected to the sleeve. The sleeve and cap are spaced from one another. The sleeve is disposed about the shaft and the retaining cap is disposed above the sleeve and movable longitudinally along the shaft between a loading/unloading position and a winding position. When in the loading/unloading position, the cap is raised and is spaced from an end of the shaft and the sleeve is disposed at the shaft wire winding region. When in the winding position, the cap is at the top of the shaft and the sleeve is disposed longitudinally downward away from and exposing the shaft wire winding region.

In such an arrangement, the sleeve includes a longitudinal slot and the sleeve slot and shaft slot align with one another when the sleeve and cap are in the loading/unloading position. A present system includes a plurality of winding assemblies and a common drive is operably connected to each of the assemblies for driving the rotating elements together.

The system includes a conveyor for moving the bales along the longitudinal direction. An operator station is positioned adjacent the winding assemblies at the longitudinal end of the system. A gate disposed between the operator station and the winding assemblies. The gate is configured to move between an open position and a closed position when the winding elements are rotating. A wire guide is associated with each of the winding assemblies. The wire guides are disposed between the winding assemblies and the receiving region to guide the wires between the bale and the winding assemblies.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
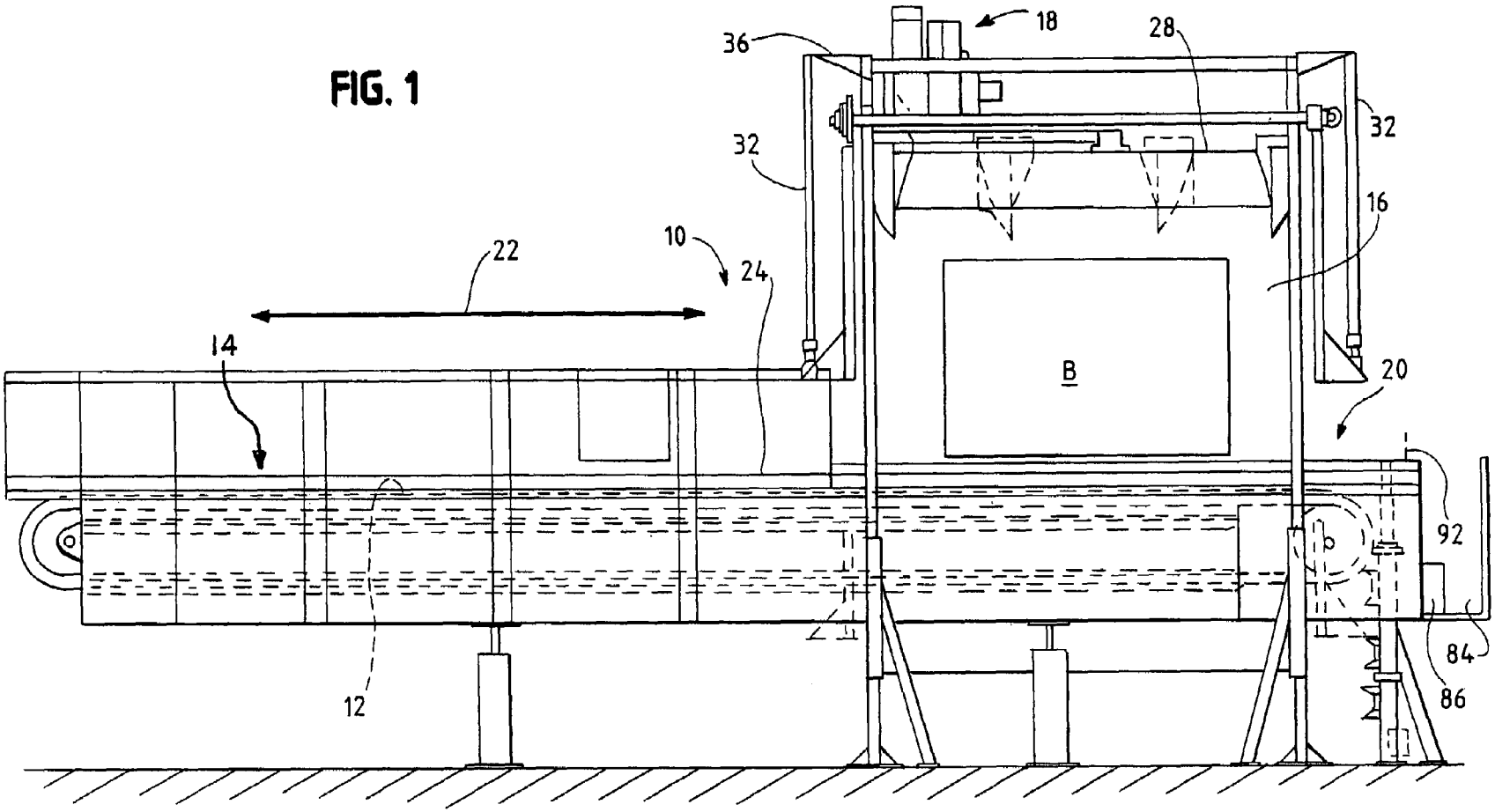
FIG. 1 is a front view of a bale dewiring system embodying the principles of the present invention, the system being shown with a bale in the receiving region.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a bale dewiring system 10 embodying the principles of the present invention. The system 10 is configured to safely remove wire W (or strapping) from a compressed bale B with minimal operator interface. Bales can be, for example, cardboard, plastic or fiber material that is highly compressed. Briefly, in operation, the system 10 receives a bale B, compresses the bale (to control later expansion), severs or cuts the wire or strapping W, releases the bale B (in a controlled manner) and winds the wire W for disposal.

The dewiring system 10 includes a conveyor 12 to move bales B into the system 10 and to move the decompressed material out of the system 10, a receiving station 14, a compression station 16, a cutting station 18, and a wire winding station 20. The conveyor 12 is configured to receive a wired or strapped bale B and convey the bale B in the compression station 16. The conveyor 12 receives the bale B with the wire W oriented in the direction of movement of the bale (indicated generally by the arrow at 22); that is, the wires W are oriented along the path of travel of the bale B. It will be appreciated by those skilled in the art, that this orientation is quite advantageous over the transverse orientation of known systems. In this orientation, the direction of expansion or decompression of the bale B is in the direction of travel 22 of the bale B, i.e., along the conveyor path 24. Thus, expansion of the bale B is not limited by the sides 26 of the apparatus that define the conveyor path. Rather, the bale B is allowed to expand in the direction of travel 22, along the conveyor, without undue restriction by the side walls 26 of the apparatus 10.

The compression region 16 includes an upper platen 28 that compresses the bale B downward, and a pair of lateral or side plates 30 that compress the bale B inward in the direction of baling. That is, in the compression region 16, the bale B is compressed downward and inward in the compressed direction.

The upper platen 28 is moved or driven by a plurality of hydraulic cylinders 32 that "pull" the upper platen 28 downward. In a present bale dewiring device 10, a carriage 34 carries the upper platen 28 and the four cylinders 32 drive the carriage 34 to move the upper platen 28. Cylinders 32 are positioned at about respective corners of the carriage 34.

Figure 2:
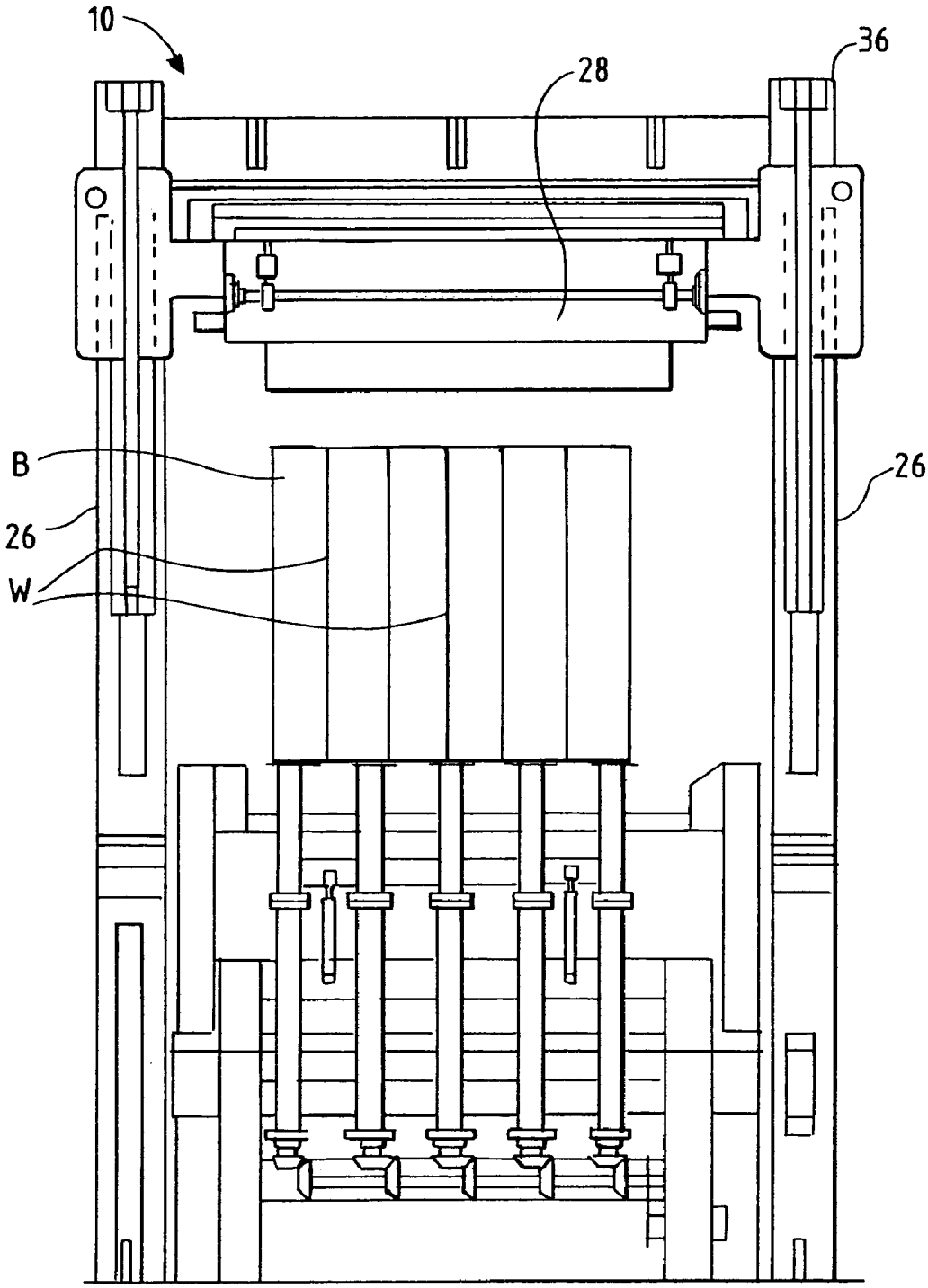
FIG. 2 is a side view of the bale dewiring system.
Figure 3:
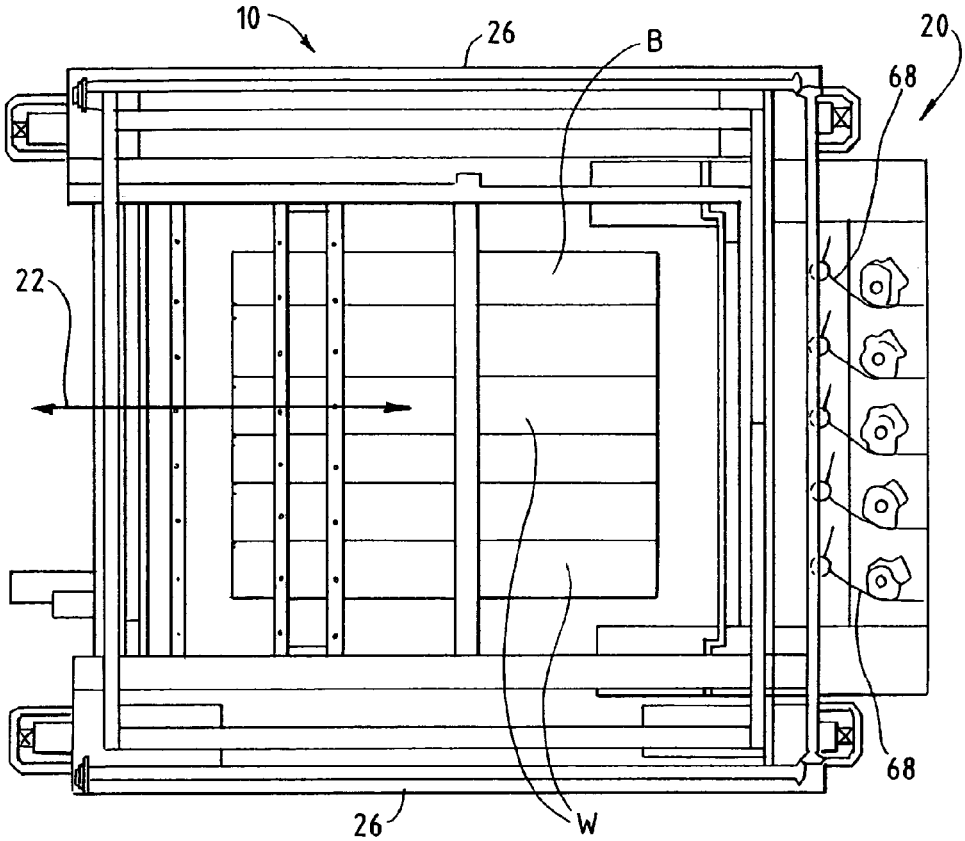
FIG. 3 is a top view of the bale dewiring system.
Figure 4:
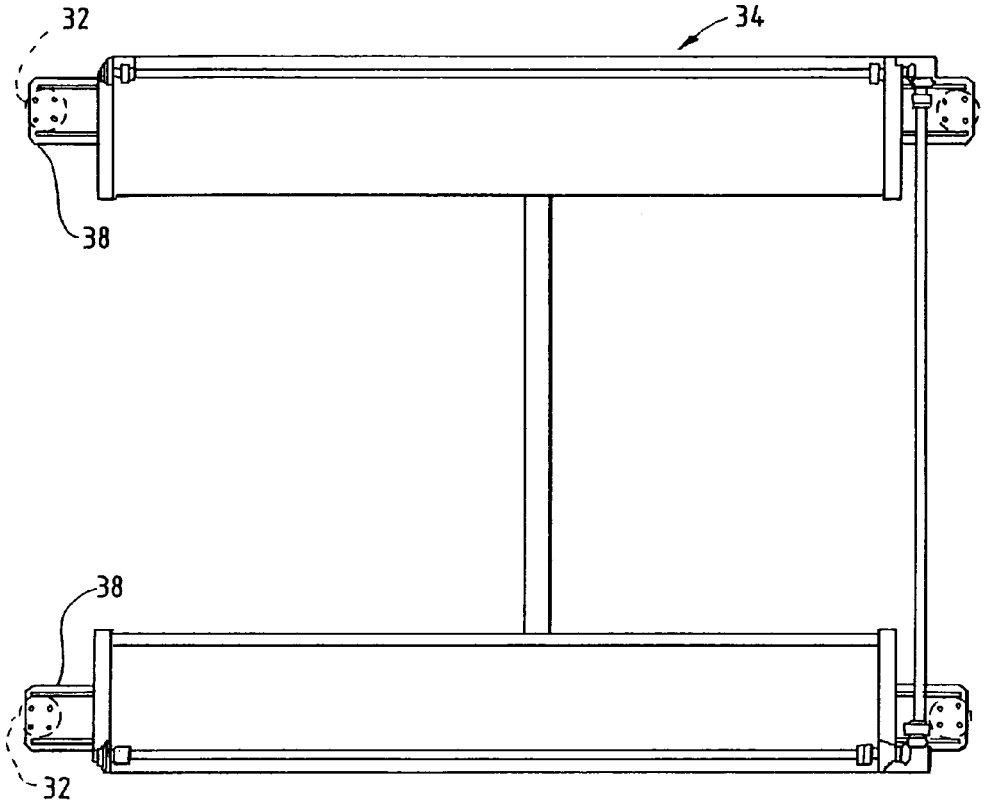
FIG. 4 is a top view of the upper carriage.
Figure 5:
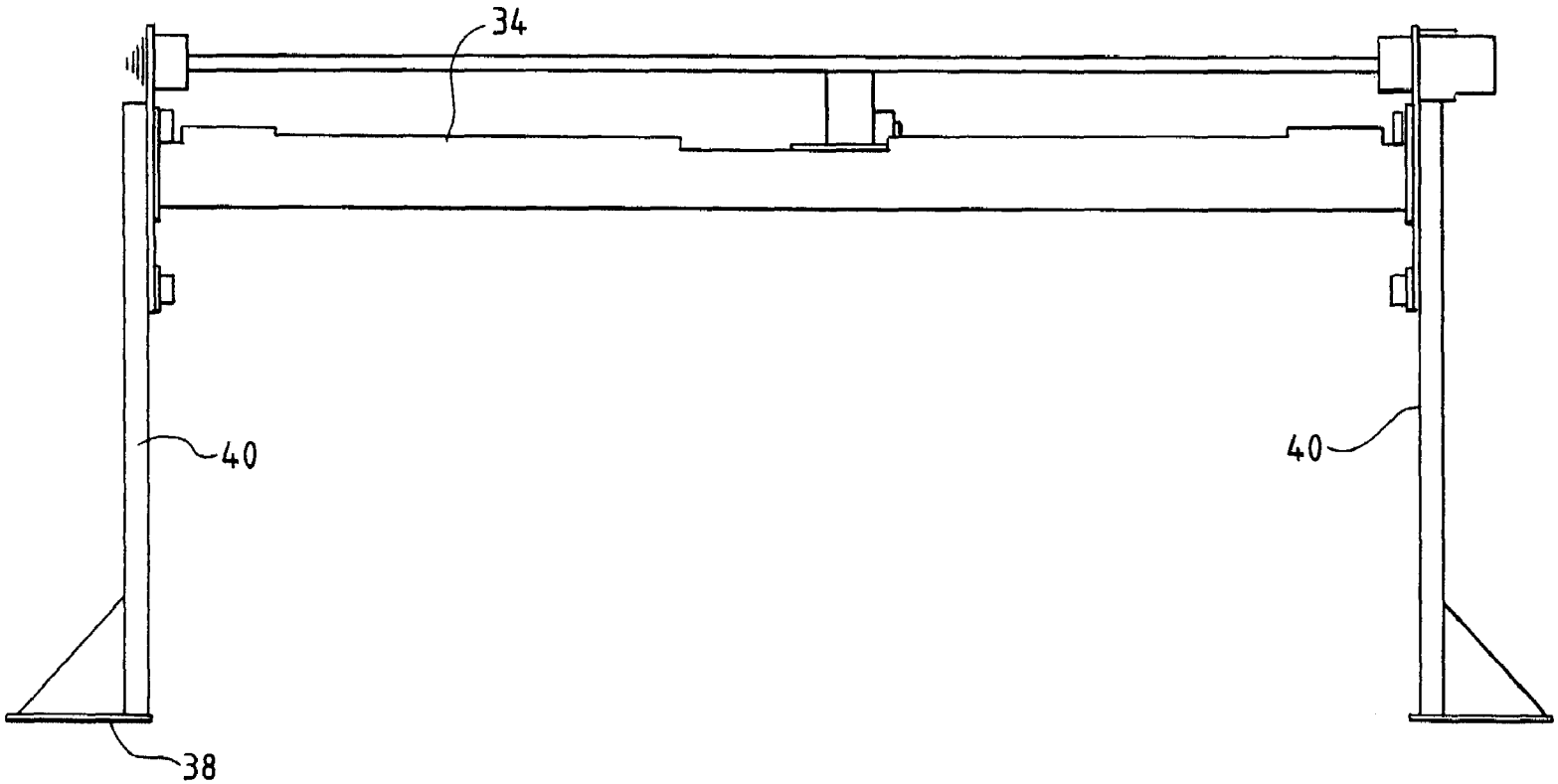
FIG. 5 is a front view of the carriage.
Figure 6:
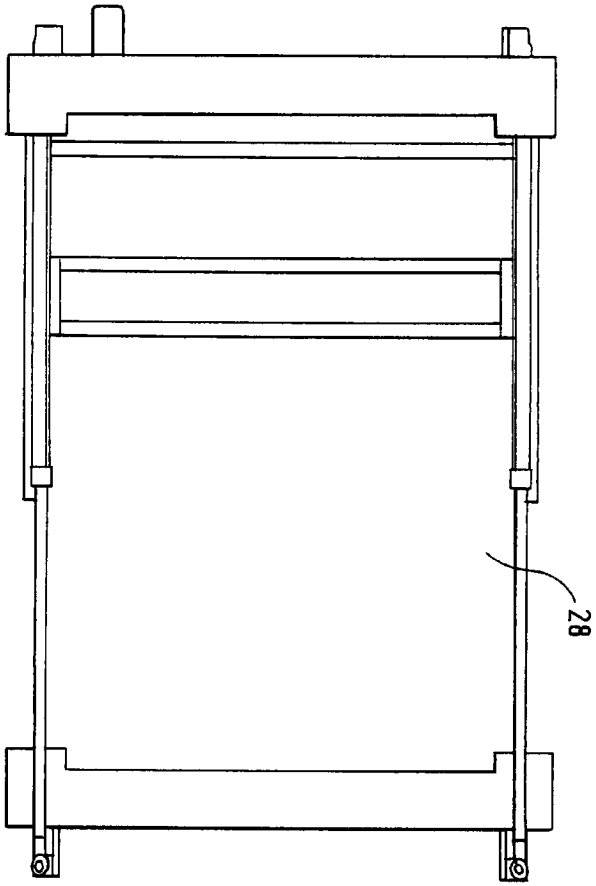
FIG. 6 is a top view of the upper platen.
Figure 7:
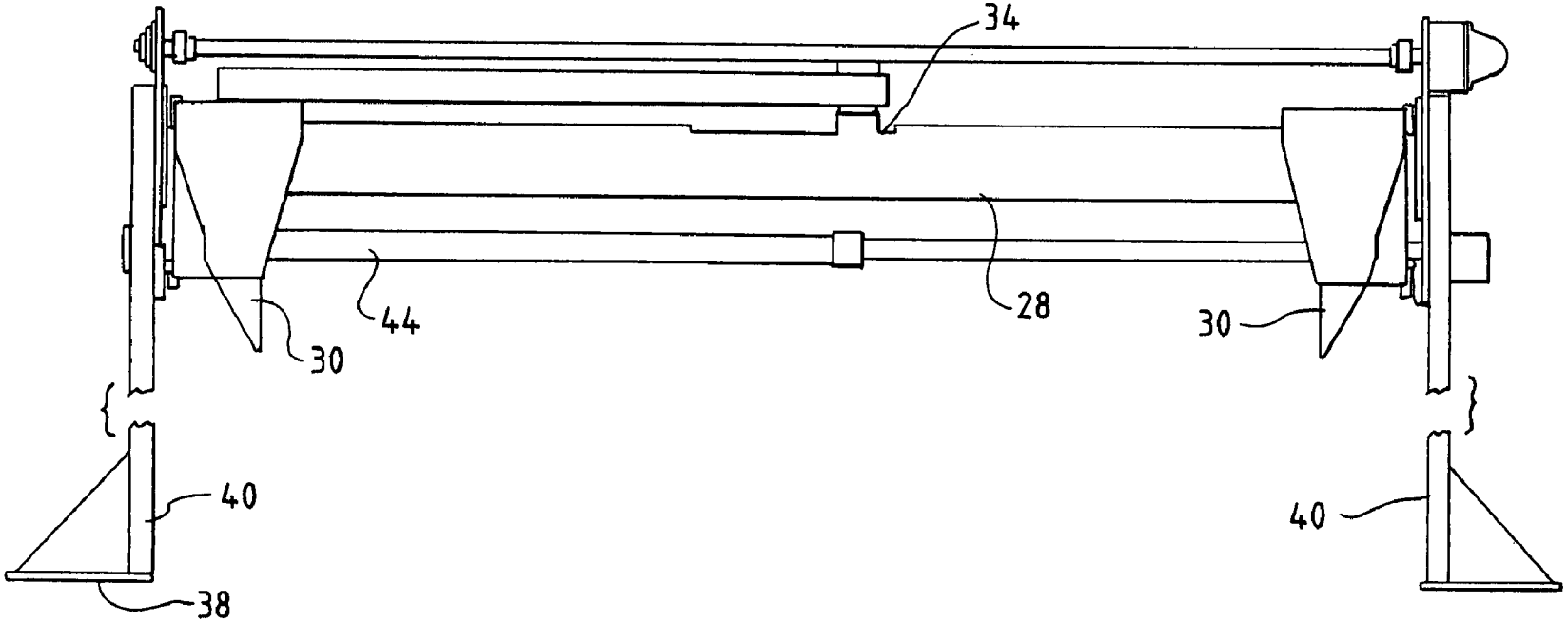
FIG. 7 is a front view of the upper platen.
Figure 8:
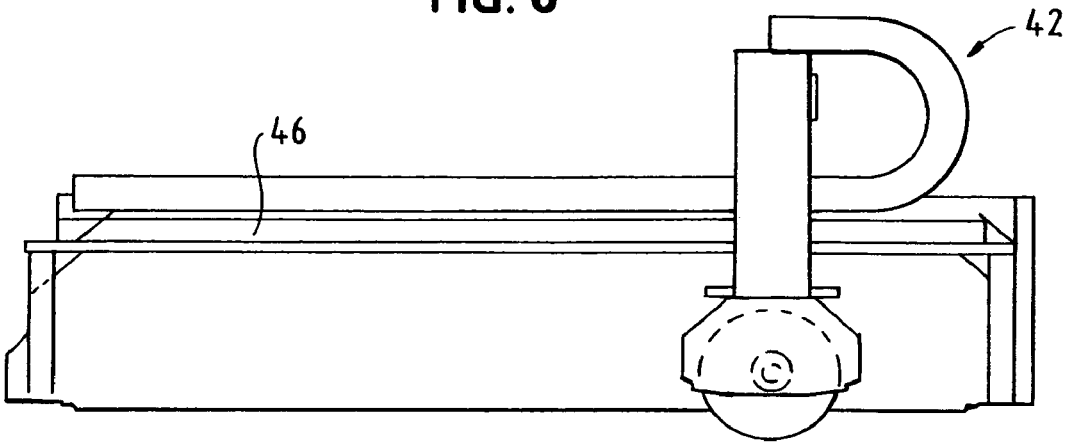
FIG. 8 is a side view of the saw assembly mounted to the saw rail.
Figure 9:
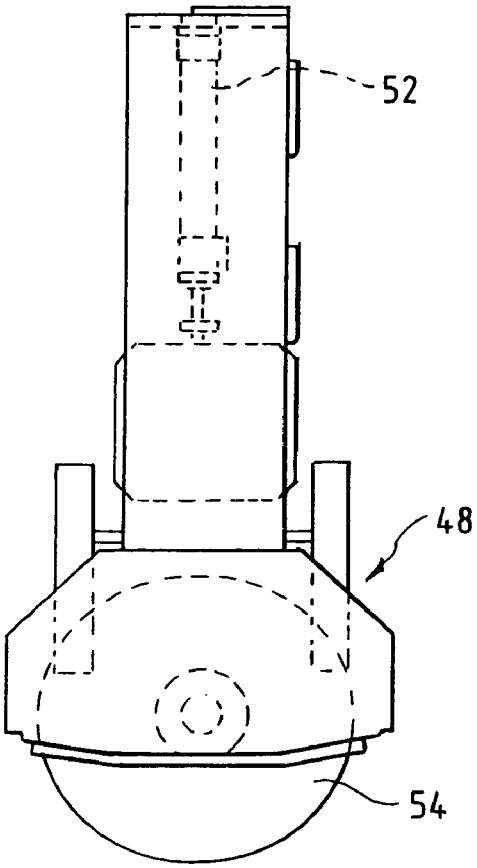
FIG. 9 is a side view of the saw assembly.
Figure 10:
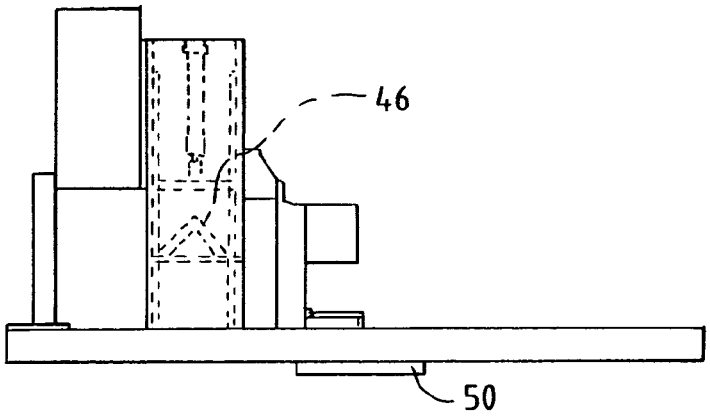
FIG. 10 is a front view of the saw assembly mounted to the rail.
Figure 11:
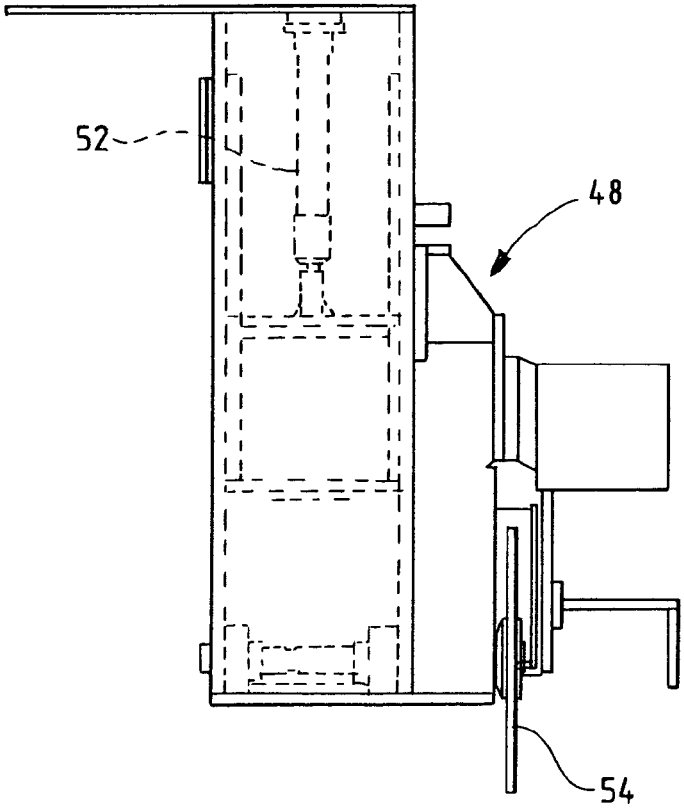
FIG. 11 is a front view of the saw assembly.
Figure 12:
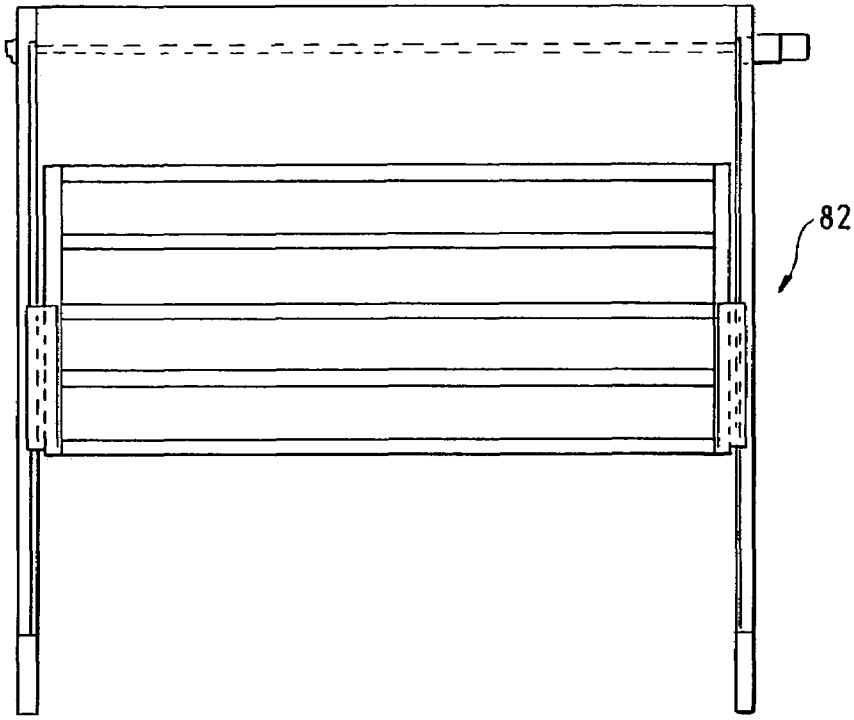
FIG. 12 is a front view of the receiving region gate.
Figure 13:
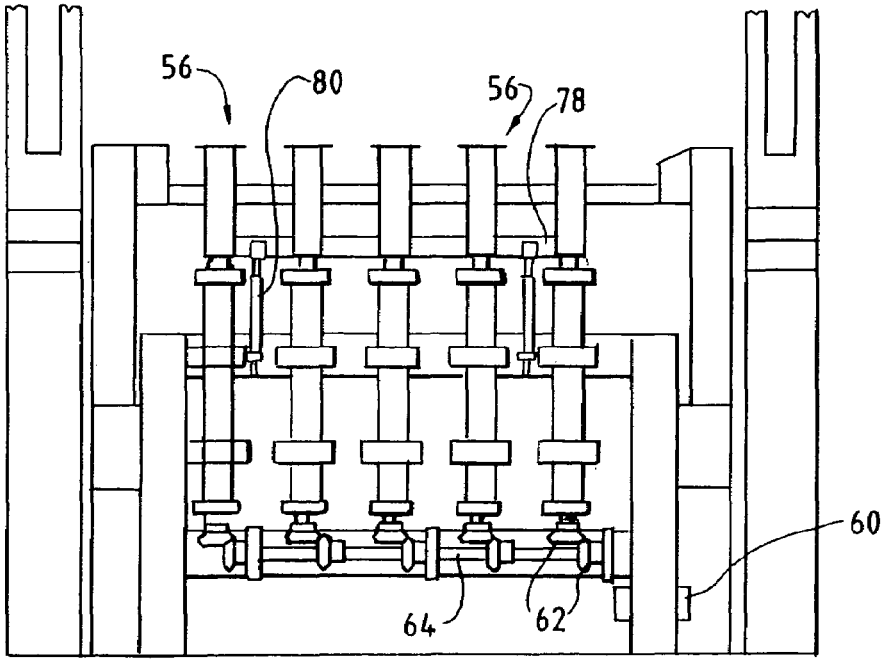
FIG. 13 is a side view of a winding assembly.
Figure 14:
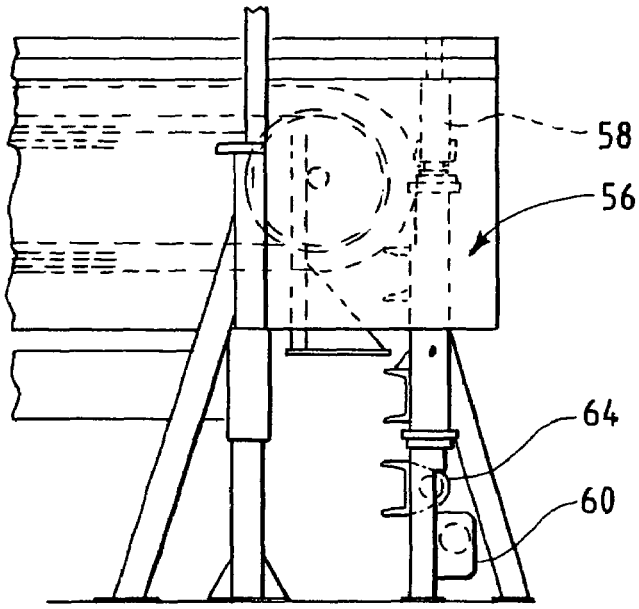
FIG. 14 is a front view of the winding assembly.

As seen in FIGS. 1, 2 and 4, the 32 cylinder is mounted, at an upper end, to a fixed portion of the frame 36. A lower end of the cylinder 32 is mounted to a foot 38, to which a leg 40 of the upper platen carriage 34 is also mounted. In this manner, as the cylinder 32 retracts, it "pulls" the foot 38, raising the carriage 34, which in turn raises the upper platen 28. Conversely, extension of the cylinder 32 "pushes" the foot 38 down, which, in turn lowers the carriage 34 and the platen 28 (which compresses the bale).

The side plates 30 and the cutting assembly 42 are likewise carried by the carriage 34. In this manner, the entirety of the compression station 16 and the cutting assembly 42 are moved up and down with raising and lowering of the upper platen 28.

Longitudinal side compression is accomplished by the side plates 30 that, like the upper platen 28, move toward and away from the bale B to effect the desired compression. The side compression plates 30 are suspended from the carriage 34 and move toward and away from one another by actuation of a drive 44. In a present system 10, side plate 30 drive is effectuated by a plurality of (lateral) hydraulic cylinders 44 that move the compression plates 30 toward and away from one another. The lateral cylinders 44 are positioned at about the top of the carriage 34, out of the way of the bale B (i.e., out of the receiving area 14). The side (plate) compression is provided so that decompression of the bale B, following cutting of the wires W, occurs in a controlled manner. That is, the bale B is compressed by inward movement of the side plates 30. The wires W are then cut and the bale B expands (decompresses) up against the side plates 30. The side plates 30 are subsequently reversed and moved outward in a controlled manner to allow controlled decompression (or expansion) of the bale B.

The cutting assembly 42 is operably mounted to the upper platen 28 for (up and down) movement with the platen 28. The cutting assembly 42 is mounted to a bridge or rail 46 that is mounted to the upper platen 28 for traversing across the top of the dewiring apparatus 10. A cutting device 48, such as the illustrated saw, moves along the rail 46 transverse to the bale B, in such a manner as to traverse the bale B transverse (substantially perpendicular) to the wires W. That is, the saw 48 moves transverse to the direction of movement of the bale B in the apparatus 10 to cut the wires W that hold the bale B compressed.

In that the saw 48 develops a fairly considerable amount of friction as it moves through the bale B, the dewiring apparatus 10 includes a sensor 50 that senses the presence of the wire W and is operably connected to a controller 86 that actuates a drive 52 to move the saw 48 downward into contact with the wire W (and the bale B) to cut the wire W. In this manner the saw 48 reciprocates up (out of contact with the bale B) when it is in a position other than for wire W cutting. This prevents generating unnecessary friction by maintaining the rotating saw blade 54 out of contact with the bale B when the blade 54 is not cutting wire W. This saves wear on the saw blade 54, reduces heat generation in the material and can reduce contamination and destruction of the material due to overheating and/or burning.

The wire sensor 50 moves along the rail 46 with the saw assembly 42. The sensor 50, however, is positioned low (relative to the saw assembly 42) so that it contacts or is in close proximity to the bale B. In this manner, the sensor 50 remains close to (or on) the bale B, while the saw 48 moves up and down into and out of contact with the bale B as the blade 54 nears the wire W. Close proximity of the sensor 50 to the bale B, and eliminating the up-and-down movement of the sensor 50 permits the sensor 50 to more accurately sense the location of the baling wires W.

In order to remove the wires W from the bales B (after being cut), the apparatus 10 includes a wire winding station 20 having a plurality of wire winding assemblies 56. The wire winding assemblies 56 are configured to collect the wires, into a readily handled winding (e.g., a "ball" of wire), for easy, safe handling.

The winding assemblies 56 (five shown in the illustrated embodiment) each include a winding post 58 operably connected to a drive 60 to rotate the post 58. The post 58 has a longitudinal slot 66 formed therein for receiving the wire W. As such, with the wire W pulled into the post slot 66, as the post 58 rotates, the wire W is pulled from the bale B and wound onto the post 58. In a present embodiment, the posts 58 are driven by a common drive 60 having a shaft 64 and mating crown gears 62 (one set for each post 58) to drive each of the posts 58 from the shaft 64.

In order to retain the wires W on their respective posts 58 and guide the wires W, each winding assembly 56 includes a stationary wire guide 68 around which the wire W is threaded. The guide 68 provides a predetermined path through which the wire W traverses toward the winding post 58. The guide 68 is spaced from the post 58 (and positioned between the bale B and the post 58) to prevent tangling of the wire W as it is pulled from the bale B onto the post 58.

Figure 15A:
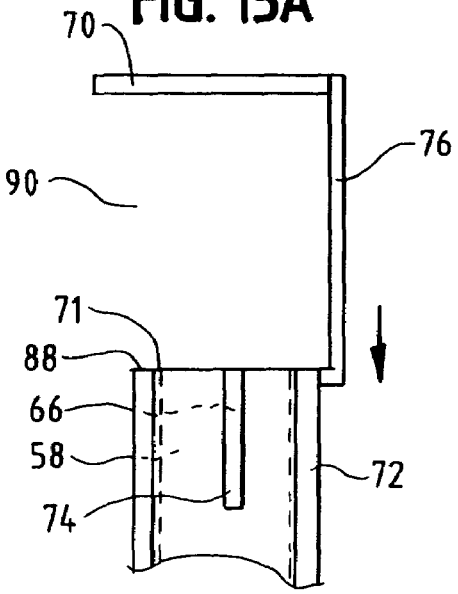
FIGS. 15A and 15B are illustrations of the winding assembly, showing the post, sleeve, cap and connecting arm, in the loading/unloading position and the winding position, respectively.

The assembly 56 also includes a retaining cap 70 and sleeve 72 that move (as a single unit) up and down on the post 58, such that the cap 70 moves into and out of engagement with the top 71 of the post 58. The cap 70 and sleeve 72 are connected to one another by a connecting arm 76. The retaining cap 70 and sleeve 72 move down so that the cap 70 is engaged with (e.g., disposed at the top 71 of) the post 58 as the wire W is wound on the post 58. This prevents the wire W from inadvertently exiting the top of (slot 66 in) the post 58. The retaining sleeve 72 is disposed around the post 58 and, like the post 58, includes a longitudinal slot 74. The sleeve 72, however, does not rotate with the post 58. Rather, when the wire W is being loaded onto the winding assembly 56, the retaining cap 70 and sleeve 72 are in the up or loading/unloading position (FIG. 15A). In this position, the cap 70 is raised and is spaced (upwardly) from the top 71 of the post 58. Also while in this position the sleeve 72 is up, and is longitudinally at about the same height as the post 58 (thus surrounding the post 58). In the loading/unloading position the post slot 66 and the sleeve slot 74 are aligned with one another.

Figure 15B:
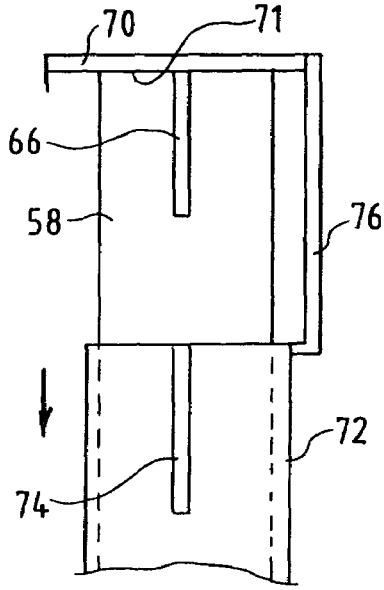

The cap 70 and sleeve 72 then move downward (FIG. 15B). This positions the cap 70 at the top of the post 58 to prevent the wire W from corning off of the post 58. This also drops the sleeve 72 from about the post 58, thus exposing the post 58. Although the sleeve 72 drops down, the wire W remains threaded through the post slot 66.

The drive 60 is then actuated and the wire W is wound onto the post 58. When winding is complete, the cap 70 and sleeve 72 move up. This raises the cap 70 from the post 58 and, at the same time, moves the sleeve 72 up about the outside of post 58, thus pushing the wound wire W up on the top or lip 88 of the sleeve 72 and off of the post 58. The wire W is thus set up on top of the post 58 and sleeve 72 and is readily removed. Because the wire W winds around the post 58, it forms a "ball" of wire that is safe and easy to handle and ready for disposal.

In a present embodiment, the caps 70 and sleeves 72 from each of the assemblies 56 mounted to a common bracket 78 to move the caps 70 and sleeves 72 between the loading/unloading and winding positions together. The bracket 78 can be moved up and down (i.e., driven) by, for example, the exemplary cylinder 80, or like drive device.

The apparatus 10 can include safety gates and safety bars. A first entrance gate 82 extends across the entrance to the receiving station 14. The gate 82 moves up and down, to move into place after placing the bale B in position on the conveyor 12.

A guard 92 (FIG. 1) is positioned between the winding assemblies 56 and the operator station 84. As the winding assemblies 56 are actuated (as the caps 70 and sleeves 72 move down to expose the posts 58), the guard 92 moves up to prevent the operator from reaching in to the area of the winding assemblies 56 and to prevent debris for being ejected from about the winding assemblies 56.

In use, the entrance gate 82 is up and an operator loads the bale B into the dewiring apparatus 10. It is anticipated that the bale B will be loaded into the apparatus 10 using a forklift. The bale B is placed on the conveyor 12, with the wires W oriented in the direction of movement 22 of the conveyor 12.

The operator then actuates a control system 86 to begin a cycle. The entrance gate 82 closes and the upper platen 28 moves down to contact and downwardly compress the bale B. The side compression plates 30 move inward to inwardly compress the bale B (in the direction of the baling wire W orientation).

The cutting assembly 42 is actuated and the saw assembly moves along the rail 46. As the saw 48 moves along the rail 46, the sensor 50, which is positioned low on the rail 46, senses the presence of a wire W, and signals the saw 48 to reciprocate downwardly and cut the wire W. The saw 48 then reciprocates back up, out of contact with the bale B (and the wire W) as the cutting assembly continues to move along the rail 46. When the presence of another wire W is sensed, the saw 48 again reciprocates downwardly to cut the wire W and back up out of the bale B when cutting is complete.

When the saw assembly 42 reaches the terminal side of the rail 46, the saw 48 reciprocates up (if in the downward position), the upper platen 28 begins to raise, moving away from the bale and the side compression plates 30 move away from the bale B. Due to the compressed nature of the bale B, the bale B expands; however, expansion is contained and is controlled by controlling the speed at which the upper platen 28 moves up and the side plates 30 move away from the bale B.

Following the upper platen 28 reaching the uppermost position and the side plates 30 reaching the outermost position, the operator (typically) actuates the conveyor 12 in the rearward direction to move the decompressed bale B toward the winding assemblies 56. At this point in time, the winding assemblies 56 are in the loading/unloading position (as opposed to the winding position). The operator then loosens the cut wire W from the bale B and positions the wire W through the sleeve slot 74 and the winding post slot 66.

The winding assembly 56 is then actuated which raises the (winding assembly) guard 92, while lowering the cap 70 and sleeve 72. This positions the cap 70 on the top of the post 58 (to prevent the wire W from jumping from the post 58) and exposes the post 58. The drive 60 rotates to rotate the post 58 which winds the wire W onto the post 58. When winding is complete, the drive 60 stops, the cap 70 and sleeve 72 rise which pushes the coiled wire W off of the post 58, up on to the lip 88 of the sleeve 72 and into the space 90 between the cap 70 and sleeve 72. The coiled or balled wire W is then readily removed and discarded. The operator can then start the conveyor 12 to move the (unbaled and) loosened material from the dewiring apparatus 10 to a downstream process.

All patents referred to herein, are hereby incorporated herein by reference, whether or not specifically done so within the text of this disclosure.

In the disclosures, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A bale dewiring system for removing one or more wires wrapped around a bale from the bale, comprising:

a frame;

a receiving region defined by the frame and defining a longitudinal direction, the receiving region configured for receiving the bale;

an upper compression platen mounted to the frame, the upper compression platen configured for vertical movement into contact with the bale to compress the bale, and out of contact with the bale;

a rail operably mounted to the upper platen for vertical movement therewith, the rail mounted transverse to the longitudinal direction;

a cutting assembly mounted to the rail for movement along the rail, the cutting assembly including a cutting element for cutting the one or more wires;

side compression plates movable in the longitudinal direction into contact with the bale to compress the bale, and out of contact with the bale;

at least one winding assembly operably mounted to the frame, the winding assembly including a rotating winding element having a wire receiving region and a wire winding region, wherein a bale having one or more wires wrapped around the bale is positioned in the receiving region with the wires oriented in the longitudinal direction, and wherein the upper platen moves vertically downward to compress the bale and the side compression plates move into contact with the bale to compress the bale, and wherein the cutting assembly traverses along the rail to cut the one or more wires, and wherein the upper platen and side compression plates move away from the bale, and the one or more cut wires are positioned in respective rotating winding element wire receiving regions, the wires being wound onto the rotating element for removal from the bale.

2. The bale dewiring system in accordance with claim 1 wherein the cutting element is movable into contact with the bale and wire to cut the wire and out of contact with the bale following cutting the wire, movement into and out of contact with the bale being independent of the cutting assembly movement along the rail.

3. The bale dewiring system in accordance with claim 2 including a sensor operably connected to the cutting assembly and configured to sense the presence of a respective one of the wires as the cutting assembly moves along the rail to move the cutting element into contact with the bale and wire to cut the wire.

4. The bale dewiring system in accordance with claim 1 wherein the rotating winding element is a rotating shaft.

5. The bale dewiring system in accordance with claim 4 wherein the wire receiving region includes a longitudinal slot formed in the shaft for receiving the wire and wherein the wire winds around the shaft as the shaft rotates.

6. The bale dewiring system in accordance with claim 5 wherein the winding assembly includes a sleeve and a retaining cap operably connected to the sleeve, the sleeve and cap spaced from one another, the sleeve disposed about the shaft and the retaining cap disposed above the sleeve and movable longitudinally along the shaft between a loading/unloading position and a winding position, wherein in the loading/unloading position the cap is disposed spaced from an end of the shaft and the sleeve is disposed at the shaft wire winding region and wherein in the winding position, the cap is disposed adjacent an end of the shaft and the sleeve is disposed longitudinally downward away from and exposing the shaft wire winding region.

7. The bale dewiring system in accordance with claim 6 wherein the sleeve includes a longitudinal slot.

8. The bale dewiring system in accordance with claim 7 wherein the sleeve longitudinal slot and the shaft longitudinal slot align with one another when the sleeve and cap are in the loading/unloading position.

9. The bale dewiring system in accordance with claim 1 including a plurality of winding assemblies, and including a drive operably connected to each of the plurality of winding assemblies for commonly driving the rotating elements.

10. The bale dewiring system in accordance with claim 1 wherein the at least one winding assembly is disposed at a longitudinal end of the bale dewiring system.

11. The bale dewiring system in accordance with claim 10 including an operator station adjacent the at least one winding assembly at the longitudinal end of the system and including a gate disposed between the operator station and the at least one winding assembly, the gate configured to move between an open position and a closed position when the rotating winding element is rotating.

12. The bale dewiring system in accordance with claim 1 including a conveyor disposed for longitudinal movement along the longitudinal direction.

13. The bale dewiring system in accordance with claim 1 including a wire guide associated with the at least one winding assembly, the wire guide disposed between the winding assembly and the receiving region, wherein a wire is guided by the wire guide from the bale to the winding assembly.

14. A bale dewiring system for removing one or more wires wrapped around a bale from the bale, comprising:

a frame;

a receiving region defined by the frame and defining a longitudinal direction, the receiving region configured for receiving the bale;

an upper compression platen mounted to the frame, the upper compression platen configured for vertical movement into contact with the bale to compress the bale, and out of contact with the bale;

a rail operably mounted to the upper platen for vertical movement therewith;

a cutting assembly mounted to the rail for movement along the rail, the cutting assembly including a cutting element for cutting the one or more wires;

side compression plates movable in the longitudinal direction into contact with the bale to compress the bale, and out of contact with the bale;

at least one winding assembly operably mounted to the frame, the winding assembly including a rotating winding element having a wire receiving region and a wire winding region, wherein a bale having one or more wires wrapped around the bale is positioned in the receiving region and wherein the upper platen moves vertically downward to compress the bale and the side compression plates move into contact with the bale to compress the bale, and wherein the cutting assembly traverses along the rail to cut the one or more wires, and wherein the upper platen and side compression plates move away from the bale, and the one or more cut wires are positioned in respective rotating winding element wire receiving regions, the wires being wound onto the rotating element for removal from the bale.

15. The bale dewiring system in accordance with claim 14 wherein the rotating winding element is a rotating shaft.

16. The bale dewiring system in accordance with claim 15 wherein the wire receiving region includes a longitudinal slot formed in the shaft for receiving the wire and wherein the wire winds around the shaft as the shaft rotates.

17. The bale dewiring system in accordance with claim 16 wherein the winding assembly includes a sleeve and a retaining cap operably connected to the sleeve, the sleeve and cap spaced from one another, the sleeve disposed about the shaft and the retaining cap disposed above the sleeve and movable longitudinally along the shaft between a loading/unloading position and a winding position, wherein in the loading/unloading position the cap is disposed spaced from an end of the shaft and the sleeve is disposed at the shaft wire winding region and wherein in the winding position, the cap is disposed adjacent an end of the shaft and the sleeve is disposed longitudinally downward away from and exposing the shaft wire winding region.

18. The bale dewiring system in accordance with claim 17 wherein the sleeve includes a longitudinal slot.

19. The bale dewiring system in accordance with claim 18 wherein the sleeve longitudinal slot and the shaft longitudinal slot align with one another when the sleeve and cap are in the loading/unloading position.

20. The bale dewiring system in accordance with claim 14 including a plurality of winding assemblies, and including a drive operably connected to each of the plurality of winding assemblies for commonly driving the rotating elements.

21. The bale dewiring system in accordance with claim 14 wherein the at least one winding assembly is disposed at a longitudinal end of the bale dewiring system.

22. A bale dewiring system for removing one or more wires wrapped around a bale from the bale, comprising:

a frame;

a receiving region defined by the frame and defining a longitudinal direction, the receiving region configured for receiving the bale;

an upper compression platen mounted to the frame, the upper compression platen configured for vertical movement into contact with the bale to compress the bale, and out of contact with the bale;

a rail operably mounted to the upper platen for vertical movement therewith, the rail mounted transverse to the longitudinal direction;

a cutting assembly mounted to the rail for movement along the rail, the cutting assembly including a cutting element for cutting the one or more wires;

side compression plates movable in the longitudinal direction into contact with the bale to compress the bale, and out of contact with the bale;

at least one winding assembly operably mounted to the frame for winding the one or more wires, wherein a bale having one or more wires wrapped around the bale is positioned in the receiving region with the wires oriented in the longitudinal direction, and wherein the upper platen moves vertically downward to compress the bale and the side compression plates move into contact with the bale to compress the bale, and wherein the cutting assembly traverses along the rail to cut the one or more wires, and wherein the upper platen and side compression plates move away from the bale, and the one or more cut wires are wound by the at least one winding assembly for removal from the bale.

23. The bale dewiring system in accordance with claim 22 wherein the cutting element is movable into contact with the bale and wire to cut the wire and out of contact with the bale following cutting the wire, movement into and out of contact with the bale being independent of the cutting assembly movement along the rail.

24. The bale dewiring system in accordance with claim 22 including a sensor operably connected to the cutting assembly and configured to sense the presence of a respective one of the wires as the cutting assembly moves along the rail to move the cutting element into contact with the bale and wire to cut the wire.

* * * * *